US005370364A

United States Patent [19]

Kenmoku et al.

[11] Patent Number: 5,370,364

[45] Date of Patent: Dec. 6, 1994

[54] TITANIUM ALLOY ENGINE VALVE SHAFT STRUCTURE

[75] Inventors: Takeji Kenmoku, Fujisawa; Shinichi Umino, Yugawara; Eiji Hirai; Kazuyoshi Kurosawa, both of Atsugi; Yoshio Matsumura, Hiratsuka, all of Japan

[73] Assignee: Fuji Oozx Inc., Fujisawa, Japan

[21] Appl. No.: 235,104

[22] Filed: Apr. 29, 1994

[30] Foreign Application Priority Data

Nov. 4, 1992 [JP] Japan ..... 4-317993
Nov. 4, 1992 [JP] Japan ..... 4-317994

[51] Int. Cl.[5] ..... F01L 3/10
[52] U.S. Cl. ..... 251/368; 123/188.3
[58] Field of Search ..... 251/368; 123/188.3

[56] References Cited

U.S. PATENT DOCUMENTS 2,125,299 8/1938 Krivobok ..... 123/188.3
3,876,475 4/1975 Ramquist ..... 123/188.3
4,122,817 10/1978 Matlock ..... 123/188 AA
4,732,364 3/1988 Seger et al. ..... 251/368
4,788,082 11/1988 Schmitt ..... 427/248.1
4,838,218 6/1989 Sato et al. ..... 123/188.3
4,951,920 8/1990 Tsuno ..... 251/368
5,084,113 1/1992 Mori et al. ..... 123/188.3
5,222,521 6/1993 Kihlberg ..... 251/368
5,249,554 10/1993 Tamor et al. ..... 123/188.3

FOREIGN PATENT DOCUMENTS 2-92494 4/1990 Japan .
5-49802 7/1993 Japan .

*Primary Examiner*—A. Michael Chambers
*Attorney, Agent, or Firm*—Zarley, McKee, Thomte, Voorhees & Sease

[57] ABSTRACT

There is provided a new structure of an engine valve made from titanium alloy, having three component coat surface layer formed on the surface of the reciprocating shaft thereof, wherein the composition of the three component coat surface layer comprises nickel, phospher and particles of material selected from the group consisting of silicone carbide, silicone nitride, boron nitride, and the combination thereof; said particles are uniformly dispersed in said coat surface layer; and said coat surface layer is formed via a binding layer or directly on the surface of the shaft.

8 Claims, 3 Drawing Sheets

TITANIUM ALLOY ENGINE VALVE SHAFT STRUCTURE

FIELD OF THE INVENTION

The present invention relates to an engine valve shaft made from titanium alloy. Particularly, it relates to the structure of a titanium alloy valve shaft to be provided for cam engagement to a cam for an engine with a camshaft placed in an internal combustion engine. More particularly, it relates to the titanium alloy valve shaft structure on the surface of which a three component coat surface layer comprising nickel, phosphorus and ceramic particulate material homogeneously and finely dispersed therein, wherein said ceramic particulate material is selected from the group consisting of silicone carbide, silicone nitride, boron nitride and the combination thereof. The three component coat surface layer is formed via a binding layer formed on the surface of the valve, or directly formed on the surface of the valve, in absence of the binding layer. The coat layer formed on the surface of the valve shaft has an improved hardness of 250 to 600 in Vicker's hardness.

DESCRIPTION OF THE PRIOR ART

A typical moving valve in use for an internal combustion engine may comprises an engine valve, a valve spring to press the valve to a closed position, a valve spring retainer for transmitting a pressure of the spring to the valve, a valve guide to hold the valve shaft along its motion, the reciprocating shaft to open and close the valve, by a rotation of a cam shaft, and a rotating cam shaft.

In a moving valve mechanism, a valve shaft is very quickly and for very long period, reciprocated in a valve guide, so as to open and close acutely periodically the valve to comply the timing of the valve with the revolution rate of the engine. Therefore, the side surface of the valve shaft slides always on the surface of a valve guide, at very high speed, and abrasion load is repeatedly applied on the contact surface of the valve shaft so as to abrade both the surfaces of the valve shaft and the valve guide. Therefore, when the valve is made from titanium or titanium alloy, it can have relatively high thermal resistance and wear resistance.

The term of "titanium alloy" used in this specification includes titanium metal and titanium based alloy. Titanium metal and its alloy have higher relative strength, and significant durability, and its alloy evidences light and strong material.

For example, an titanium based alloy containing 6 weight % of Al, and 4 weight % of V is a light weight and high strength material having higher thermal resistance to the temperature of operated engine, and higher tension strength at the high temperature of practical engine, and relative density being 60% of that of steel. Therefore, the titanium alloy has been expected in use for automobile components, e.g. engine valve material.

While a titanium alloy has higher resistance, higher relative strength and higher thermal resistance, it has relatively lower thermal conductivity and no enough abrasion resistance. Therefore, when a titanium alloy is used for a reciprocating shaft of an engine valve and the like, the requirement for the engine valve such as abrasion resistance and fatigue strength should be improved. On the other hand, an engine valve is abraded and fatigued because of repetition of sliding wears, and repetition of bending stress loading, and most of such loading are applied on the surface of the valve. Therefore, most of factors to control the life of the engine valve, and to improve the performances of the valve are due to the condition of the surface.

There have been a variety of proposals to modify or treat the surface of the titanium alloy valve, by forming specific coat layer on the surface of the titanium alloy in use for an engine valve.

There have been known as a technique for improving the physical properties of the metal surface, two methods; one is a deposition method of a coat layer on the surface of a metal member so as to impart protection function, and the other is a method of forming a new coat layer different in its properties from those of the basis matrix. As the former method, there are known a deposition in vacuum, sputtering technique such as physical deposition (physical vapor deposition), and chemical deposition (Chemical vapor deposition). As the latter method, there are known a laser processing of metal surface and plasma processing.

When a coat layer to improve abrasion resistance is formed on the surface of the titanium alloy valve by using those prior art, it is necessary to select an appropriate material to satisfy the requirement for the coat layer. However, there has not been found a method of making such appropriate coat layer to satisfy such requirement.

U.S. Pat. No. 4,122,817 discloses an engine valve having a contact surface of formed of an alloy which exhibits wear-resistant properties, PbO corrosion resistance and oxidation resistance, and the alloy containing carbon 1.4 to 2.0 wt. %, molybdenum 4.0 to 6.0 wt. %, silicon 0.1 to 1.0 wt. %, nickel 8 to 13 wt. %, chromium 20 to 26 wt. %, manganese 0 to 3.0 wt. % with balance being iron.

Japanese (Unexamined) Patent Laid-open application No. 2-92491/1990 proposed an iron-based alloy powder in use for a material to be coated on a face of an engine valve, which comprises C; 1.0 to 2.5 wt. %, Si; 0.1 to 1.0 wt. %, Mn; 3 to 12 wt. %, Ni; 15 to 25 wt. %, Cr; 20 to 30 wt. %, Mo; 5 to 15 wt. %, B; 0.005 to 0.05 wt. %, Al; 0.01 to 0.1 wt. %, O; 0.01 to 0.05 wt. % and impurities with balance being Fe.

Further, Japanese (Unexamined) Patent Laid-open application No. 5-49802/1993 proposed an engine valve having an alloy layer comprising Cr 10 to 60 wt. %, C 1 to 8 wt. %, total content of Mo, Ni, W, B, Si and Co; 5 to 20 wt. % with balance being iron, on a facing surface thereof, which is based on an austenire steel.

In a moving valve mechanism, a cam mounted on a camshaft pushes the valve through the valve shaft, so as to open and close acutely periodically the valve to comply the timing of the valve with the revolution rate of the engine.

Therefore, much stress and bending force must be loaded periodically and repeatedly on the contact surface of the valve shaft to which the guide slides in contact. Then, the stress is caused within a valve shaft.

SUMMARY OF THE INVENTION

It is an object of the present invention to provide a valve shaft having optionally higher abrasion resistance of the surface portion of the valve shaft at which the valve shaft be in contact or friction with the surface of the guide and/or repeatedly shock from the guide.

The further object of the present invention will be understood from the below description.

Detailed Description of Preferred Embodiments

Figure 1:
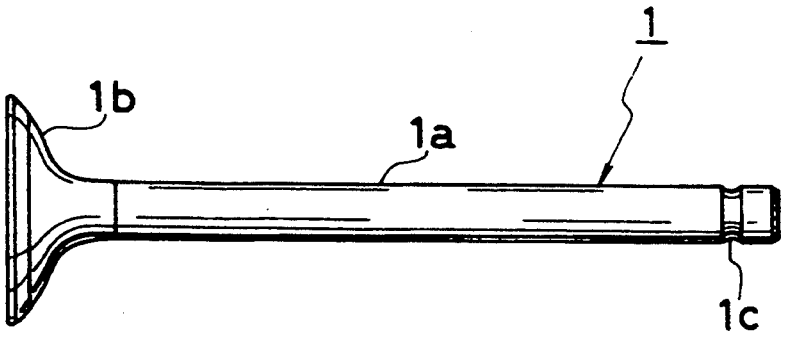
FIG. 1 shows schematically a side view of a titanium alloy valve shaft of the present invention.

In accordance with the present invention, the valve shaft should have a three component coat surface layer formed on the whole surface of the reciprocating shaft thereof, wherein the composition of the three component coat surface layer comprises nickel, phosphorus and particles of material selected from the group consisting of silicone carbide, silicone nitride, boron nitride, and the combination thereof; the particles are uniformly and homogeneously dispersed in said coat surface layer; and the coat surface layer is formed via a binding layer or directly on the surface of the shaft.

In general, while a metal member will be degraded by various reaction such as abrasion, corrosion and oxidation, most of such reactions are caused on the surface thereof. An engine valve is not exception thereof.

Therefore, there have been proposed and/on developed many methods of improving the physical properties of the surface thereof, as described before. Particularly, ceramic coating techniques have been developed so as to improve abrasion resistance and thermal resistance of metal materials. The inventors of this invention have developed a method of improving a surface propertie of the valve, to satisfy requirements for an engine valve, in regard to productivity of the coat surface layer, binding strength between the coat layer and the valve, improvement of abrasion resistance and the cost of manufacture.

As a result, the inventors have developed a method of production of a coat layer with uniform dispersion of fine ceramic particles, which comprises forming a Ni—P metal matrix layer on the surface of a titanium alloy engine valve, and dispersing fine ceramic particles of material selected from the group consisting of SiC, BN, $Si_3N_4$ and any combination thereof.

Further, the inventors have reviewed the relationship between hardness and strength (rotation bending fatigue strength) of the coat layer formed on the surface of the titanium alloy valve and further the relationship of the abrasion resistance with the hardness of the coat layer.

As a result, it has been found that where the Vicker's hardness of the coat layer formed on the surface of the titanium alloy valve is 250 to 600, the requirement of the engine valve can be satisfied. Therefore, the resolution in accordance with the present invention is formation of the coat layer having Vicker's hardness of 250 to 600, on the surface of the valve shaft which is reciprocated very fast along the surface of the valve guide.

When a rotation bending stress is repeatedly loaded on the surface of a engine valve, the stress even lower than the yielding point of tension test, and proportional limit or elastic limit of the valve may break the valve. The stresses of extent not to destruct the valve can be repeatedly an unlimited number of times loaded on the valve. The maximal stress of such stresses can be referred to as "fatigue limit". Therefore, the higher the fatigue limit is, the better the performance of the valve is.

An abrasion resistance of the engine valve is a resistance of the valve against abrasion and wear. The engine valve is reciprocated along a valve guide in an engine, and therefore, the surface thereof will wear along with the period of reciprocating or sliding each the other. As a result, it will generate complicate or combination of slight peeling off, migration, slipping off, temperature raise due to the heat of friction.

Either of the fatigue limit and abrasion resistance of the engine valve is relevant to the hardness of the coat layer. In the relationship of the hardness with the abrasion or the fatigue limit of the valve, the higher hardness can not necessarily be said to be good for both of the abrasion resistance and the fatigue limit. However, the hardness of the coat layer should be selected so as to obtain good abrasion resistance and improving fatigue limit.

Further, referring to ceramic particulate material, the present invention can be illustrated as follows.

The ceramic particulate material to be uniformly dispersed within the three component coat layer on the surface of the valve shaft in accordance with the present invention comprises material selected from the group consisting of silicone carbide (SiC), boron nitride (BN), silicone nitride ($Si_3N_4$), and the combination thereof. Such particulate material can be finely and uniformly dispersed in the coat layer to produce necessary hardness thereof to satisfy the requirement for the engine valve.

Such ceramic materials silicone carbide (SiC), boron nitride (BN), silicone nitride ($Si_3N_4$), as used in accordance with the present invention have an expanded utility in the application to a machine component, and an automobile component. Particularly, SiC and $Si_3N_4$ have been developed to be utilized in thin layer, coating and amorphous material in its application.

The properties of silicon carbide (SiC) and silicon nitride ($Si_3N_4$) are shown in Table 1. It is apparent from this table that those ceramic materials can be used to produce the valve shaft of the present invention.

TABLE 1

| | SiC | $Si_3N_4$ |
|---|---|---|
| Apparant density | 2.3–3.34 | 2–2.3 |
| Bending strength (kg/mm$^2$) | 6–95 | 5–500 |
| Fracture toughness (MN/m$^{3/2}$) | 2.4–5.6 | 1–9 |
| Thermal shock resistance ΔT (°C.) | 200–700 | 400–900 |
| Hardness (Vickers:kg/mm$^2$) | 1,800–3,700 | 1,100–1,900 |

Table 1 indicates that the properties of $Si_3N_4$ are good at bending strength, fracture strength and abrasion resistance in comparison with SiC. In accordance with one view of the present invention, mere such ceramic material is not used to form a coat layer, and the ceramic material is combined with a metal matrix comprising nickel-phosphorus, and the particles of the ceramic material are homogeneously dispersed within the metal matrix, so as to produce synergistic effect which cannot be obtained merely by metal material. In this case, the function of the particulate material is based on its higher strength; physical properties. Therefore, such ceramic particulate material as SiC and $Si_3N_4$ can be used merely or in combination.

The term "component" used for indicating "unit" constituting the coat layer to be formed on the surface of an engine valve means each component of nickel, phosphorus and particles of ceramic material; three components. Therefore, the fine particles of the ceramic material may be "SiC", "BN", "$Si_3N_4$" and the combination thereof.

The composition of the three component coat layer to be formed on the surface of the titanium alloy valve shaft in accordance with the present invention may include Ni—P—SiC, Ni—P—BN, Ni—P—$Si_3N_4$, Ni—P—(SiC+BN), Ni—P—(SiC+$Si_3N_4$), Ni—P—(SiC+$Si_3N_4$) and Ni—P—(SiC+BN+$Si_3N_4$).

The factors to control the performance or feature of the three component coat layer to be formed on the surface of the titanium alloy valve may be the content of ceramic particulate material, size and size distribution of the ceramic particles, shape of the particles, and interfacial stability between the particles and metal matrix. Therefore, such factors should be selected in view of desired abrasion resistance of the three component coat layer comprising Ni—P—dispersed ceramic fine particles to be finally formed on the surface of the valve in accordance with the present invention.

The size of the ceramic particles to be dispersed in the coat layer is preferably below ten and several micrometer, and more preferably 1 to 5 micrometer. When the size is below one micrometer, and then the particles are very finely divided, the abrasion resistance improvement can not be expected so much.

One of SiC, BN and $Si_3N_4$ can be used, but the combination of the two or more selected from SiC, BN and $Si_3N_4$. Further, the size of the particles can be the same, or the different sizes of the particles can be used and further, the size distribution to get closest packing can be used.

The content of the particular material based on the weight of the coat layer is preferably 2 to 10%, and more preferably 2 to 7%.

The thickness of the three component coat layer comprising Ni—P—fine particles of ceramic material to be formed on the titanium alloy valve is preferably 10 to 30 micrometer. This thickness should be selected optionally in view of desired hardness of the coat layer, the cost of the preparation of the coat layer, and the productivity thereof.

Therefore, this invention is not restricted particularly by any of the method of forming a three component coat surface layer on the whole surface of the valve shaft.

For example, there have been known as a technique for improving the physical properties of the metal surface, a deposition method of a coat layer on the surface of a metal member so as to impart protection function, and a method of forming a new coat layer different in its properties from those of the basis matrix. As the former method, there are known a deposition in vacuum, sputtering technique such as physical deposition (physical vapor deposition), and chemical deposition (Chemical vapor deposition). As the latter method, there are known a laser processing of metal surface and plasma processing. Alternatively, there can be used prior arts such as electroplating technique, non-electrolysis plating technique and mechanical plating.

Firstly, the present invention is described in reference to an electroplating. For example, a plating process in accordance with ASTM No. 1 process can be used for forming a Ni—P—ceramic particles coat layer on a titanium alloy valve surface. An electroplating bath, e.g. sulfamic bath is used for plating a coat layer of Ni—P—ceramic particles of material selected from SiC, BN, $Si_3N_4$ and the combination thereof. Before such plating, nickel plating takes place to form a binding layer of nickel having thickness of 10 to 30 micrometer. The thickness of the binding nickel layer is at least one micrometer. Such nickel layer is to improve the binding strength of the inventive ceramic layer to the titanium alloy valve shaft. This binding layer is not necessary to The requirement of the present invention.

After thermal treatment of the undercoat of nickel, the dispersion plating is carried out. This is one of the important keys of the present invention.

The purpose of the dispersion plating is to form as a top coat a three component layer of Ni—P matrix containing uniformly dispersed fine ceramic particles, in order to improve abrasion resistance and thermal resistance of the top coat layer.

The features of the dispersion plating resides in that while the phosphorus source and the ceramic fine particles being difficult to be dissolved are uniformly dispersed, metal matrix of Ni—P is deposited together with the deposition of fine ceramic particles, so that the three component layer of the metal matrix containing uniformly dispersed ceramic particles is deposited or formed.

The combination of Ni—P metal matrix and fine particles can enable to get synergistic effect which can not be obtained merely by one component coat layer. Such synergistic function is one of the features of the dispersion plating in accordance with the present invention.

The plating bath and ceramic particles to be used will be explained.

One example of the plating bath to be used in the dispersion plating may be a Watt's bath and sulfamic bath containing as a phosphorus source 1 to 10 g/l of sodium hypophosphite. The deposit of Ni—P formed by plating from the plating bath containing a phosphorus source is used as a matrix for dispersing ceramic fine particles.

The dispersion plating is carried out in a plating suspension bath containing uniformly dispersed fine ceramic particles. Therefore, the bath should be agitated continuously so as to avoid precipitation. At the same time, uniform deposition should be carried out. In view of those points, the size of the dispersed particles is preferably below ten and several micrometer, and more preferably 1 to 10 micrometer. When the size of the particles is below one micrometer, it is too small to get abrasion resistance. The improvement of the abrasion resistance can not be expected so much.

The thickness of the dispersion plated coat layer can be adjusted to the range of 300 to 500 micrometer by selecting the plating bath composition and the plating conditions. However, in view of the requirements such as the necessary improvement of abrasion resistance and the reduction of the cost of the coat layer production, the thickness of the coat layer should be quite 10 to 30 micrometer.

The hardness of the three component coat layer comprising Ni, P and particulate material selected from the group consisting of SiC, BN, $Si_3N_4$ and the combination thereof, to be formed on the surface of a titanium alloy valve ranges 250 to 600 in Vicker's hardness unit.

The present invention is further illustrated by the following examples to show the preparation of the valve shaft in accordance with the present invention, but should not be interpreted for the limitation of the invention.

EXAMPLE 1

Used Engine Valve.

The engine valve 1 made from titanium alloy of Ti—6Al—4V has a configuration as shown in FIG. 1, having a expanded end 1*b* at one end of the valve shaft 1*a* and a groove 1*c* on the whole circumference of the shaft near to the other end of the shaft.

The sample was made from titanium alloy of Ti—6Al—4V, having such shaft shade.

1. Preliminary Preparation.

The sample was dipped at the temperature of 65° C. for four minutes in an alkali defatting bath comprising the composition as shown in Table 2, so as to remove oil and grease remaining on the surface of the sample.

TABLE 2

| Alkali material | g/l |
|---|---|
| sodium triphosphate ($Na_3PO_4$) | 19 |
| sodium orthosilicate ($Na_4SiO_4$) | 19 |
| non-ionic surfactant | 0.9 |

After washed with water, the sample was dipped in a chemical bath comprising the components as shown in the following table, for one minute at room temperature until the bath generates red bubbles.

TABLE 3

| Components | Ratio |
|---|---|
| 60 wt % hydrogen fluoride | one volume |
| 69 wt % nitrate | three volume |

After washed with water, the sample was dipped in an etching bath comprising the composition as shown in Table 4, at the temperature of 85° C. for ten seconds so as to accomplish defatting from the sample, and then, washed with water.

TABLE 4

| Components | Amount |
|---|---|
| sodium dichromate | 280 g/l |
| 60 wt % hydrogen fluoride | 32 ml/l |

Undercoat nickel plating

The resulting sample was nickel plated by using a nickel plating bath containing sulfamine nickel having the composition as shown in Table 5, under the condition as shown in the lower portion of Table 5.

TABLE 5

| Components | Amount |
|---|---|
| $NiCl_2.6H_2O$ | 30 g/l |
| $Ni(NH_2SO_3)_2$ | 750 g/l |
| $H_3BO_3$ | 35 g/l |
| pH | 4.5 |
| bath temperature (°C.) | 45 |
| cathode current density (A/dm$^2$) | 8 |

The formed nickel undercoat layer was measured at its thickness by electrolysis coating thickness meter, and the measured thick was 5 micrometer.

Thermal treatment

The sample was washed with water after nickel plating, and then, heated at the temperature of 550° C. in vacuum, for three hours, so as to strengthen the metal binding between the sample and nickel undercoat layer.

Dispersion plating:

After the above thermal treatment, the sample was washed with water, and then, thereon, was plated by using the composition as shown in Table 6, under the condition as shown in the lower portion of Table 6, so as to produce a plated dispersion coating layer.

TABLE 6

| Components | Amount |
|---|---|
| $NiCl_2.6H_2O$ | 30 g/l |
| $Ni(NH_2SO_3)_2$ | 750 g/l |
| $H_3BO_3$ | 35 g/l |
| sodium hypophosphite | 10 g/l |
| SiC * | 250 g/l |
| pH | 4.5 |
| bath temperature (°C.) | 45 |
| cathode current density (A/dm$^2$) | 10 |

* is available from and manufactured by Noritake company limited; the size thereof is 1 to 3 micrometer.

Thermal treatment:

After washed with water, the sample was heated at 350° C. for one hour, so as to strengthen the metal binding between the undercoat nickel coating layer and the Ni—P—SiC three component coating layer. The thickness of the formed Ni—P—SiC coating layer was measured by using fluorescence X ray thickness measurement method, and the measured thickness is 32 micrometer.

The hardness of the three component coating layer was measured by a micro Vicker's hardness meter, the resulting hardness is 610 Hv.

EXAMPLE 2

The particles of SiC was replaced by $Si_3N_4$ available from Ube Kosan company limited, having 1 to 2 micrometer in size, but the example 1 was repeated except of this replacement, so as to form an Ni—P—$Si_3N_4$ three component coat layer. The thickness of the coat layer was 30 micrometer, and the hardness thereof was 640 Hv.

[Experiment]

The engine valves made in examples 1 and 2 were mounted on an engine in practice, and tested for durability test.

Durability Test Condition:

(1) Engine used for test; 6 cylinder ×4 valve, 2000 cc (2) test load; 6400 rpm ×4/4 loading, cooling water temperature: 60×110° C.

(3) test duration period: 200 hours.

Assessment method:

The abrasion mounts after the durability test period at an engine valve shaft and an valve guide made from iron-based sintered alloy comprising 4–5 wt % of Cu, 1.5–2.5 wt % of C, 0.4–0.5 wt % of Sn, 0.1–0.5 wt % of P and remaining Fe, through which the shaft is reciprocated were measured.

The result is shown in Table 7.

TABLE 7

| Abrasion amount (micrometer) | Example 1 (micrometer) | Example 2 (micrometer) |
|---|---|---|
| shaft surface | 1.1 | 0.8 |
| valve guide surface | 1.9 | 1.4 |

Consideration:

The allowance of abrasion of a valve shaft and a valve guide is nominally to be at maximum 50 micrometer. An engine valve made in examples 1 and 2 evidences enough durability. Further, it is evident that the coat layer of Ni—P—$Si_3N_4$ (example 2) has a little more durable than the coat layer of Ni—P—SiC (example 1).

EXAMPLE 3

Tested valve:

The engine valve 1 made from titanium alloy of Ti—6Al—4V has a configuration as shown in FIG. 1, having a expanded end 1*b* at one end of the valve shall 1*a* and a groove 1*c* on the whole circumference of the shaft near to the other end of the shaft.

The sample was made from titanium alloy of Ti—6Al—4V, having such shaft shape.

Preliminary treatment:

The sample was dipped in an alkali defatting bath of Table 8 at the temperature of 68° C. for 4 minutes so as to remove oil and grease from the surface of the sample.

TABLE 8

| Ratio and Particle Size of Used Metal Powder Component | |
|---|---|
| alkalizing agent | g/l |
| tri sodium phosphate ($Na_3PO_4$) | 18 |
| sodium orthosilicate ($Na_4SiO_4$) | 18 |
| non-ionic surfactant | 0.8 |

After washed with water, the sample was dipped in a chemical etching bath of Table 9 at a room temperature for two minutes, until red bubbles were generated.

TABLE 9

| Components | Ratio |
|---|---|
| 60 wt % hydrogen fluoride | one volume |
| 69 wt % nitrate | three volume |

After washed with water, the sample was dipped in an etching bath comprising the composition as shown in Table 10, at the temperature of 82° C., for 10 seconds, so as to accomplish defatting therefrom. After finishing, the sample was washed with water.

TABLE 10

| Components | Amount |
|---|---|
| sodium dichromate | 270 g/l |
| 60 wt % hydrogen fluoride | 31 ml/l |

Undercoat nickel plating

The resulting; sample was nickel plated by using a nickel plating bath comprising sulfamine nickel having the composition as shown in Table 11, under the condition as shown in the lower portion of Table 11.

TABLE 11

| Components | Amount |
|---|---|
| $NiCl_2.6H_2O$ | 29 g/l |
| $Ni(NH_2SO_3)_2$ | 700 g/l |
| $H_3BO_3$ | 25 g/l |
| pH | 3.9 |
| bath temperature (°C.) | 45 |
| cathode current density (Aldm$^2$) | 14 |

The formed nickel coating layer was measured at its thickness by electrolysis coating thickness meter, and the measured thick was 5 micrometer.

Thermal treatment

The sample was washed with water after nickel plating, and then, heated at the temperature of 550° C. in vacuum, for three hours, so as to strengthen the metal binding between the sample and nickel coating layer.

Dispersion coat plating:

After the above thermal treatment, the sample was washed with water, and then, the surface of which was plated by using the composition as shown in Table 12, under the condition as shown in the lower portion of Table 12, so as to produce a plated dispersion coating layer.

TABLE 12

| Components | Amount |
|---|---|
| $NiCl_2.6H_2O$ | 35 g/l |
| $Ni(NH_2SO_3)_2$ | 820 g/l |
| $H_3BO_3$ | 35 g/l |
| sodium hypophosphite | 10 g/l |
| SiC * | 300 g/l |
| pH | 3.9 |
| bath temperature (°C.) | 45 |
| cathode current density (Aldm$^2$) | 14 |

* is manufactured by Noritake company limited; the size thereof is 1 to 3 micrometer.

Thermal treatment:

After washed with water, the sample was heated at 550° C. in vacuum for one hour, so as to strengthen the metal binding between the undercoat nickel coating layer and the Ni—P—SiC three component coating layer. The thickness of the formed Ni—P—SiC coating layer was measured by using; a fluorescence X ray thickness measurement method, and the measured thickness was 20 micrometer.

The hardness of the three component coating layer was measured by a micro Vicker's hardness meter, the resulting hardness is 350 Hv.

EXAMPLE 4

The particles of SiC was replaced by $Si_3N_4$ available from Ube Kosan company limited, having 1 to 3 micrometer in size, but the example 3 was repeated except of this replacement, so as to form an Ni—P—$Si_3N_4$ three component coat layer. The thickness of the coat layer was 30 micrometer, and the hardness thereof was 350 Hv.

[Reference examples 1 to 3]

The particles of $Si_3N_4$ as used in example 4 were used, and the preparation in example 4 was repeated except of content of $Si_3N_4$ as shown in Table 13, so as to form a coat layer having the thickness as shown in Table 13, and the hardness of those layers are as shown in Table 13.

TABLE 13

| | Content of $Si_3N_4$ | Thickness of Ni—P—$Si_3N_4$ layer | Hv |
|---|---|---|---|
| Reference 1 | 0.5 wt % | 5 micrometer | 200 |
| Reference 2 | 15 wt % | 60 micrometer | 500 |
| Reference 3 | 30 wt % | 100 micrometer | 700 |

*Content of $Si_3N_4$ is in weight percent on the basis of the weight of Ni—P—$Si_3N_4$.

[Experiment]

The samples prepared in Example 4 and Reference examples 1 to 3 were tested on abrasion measurement and rotation bending fatigue test.

Figure 2:
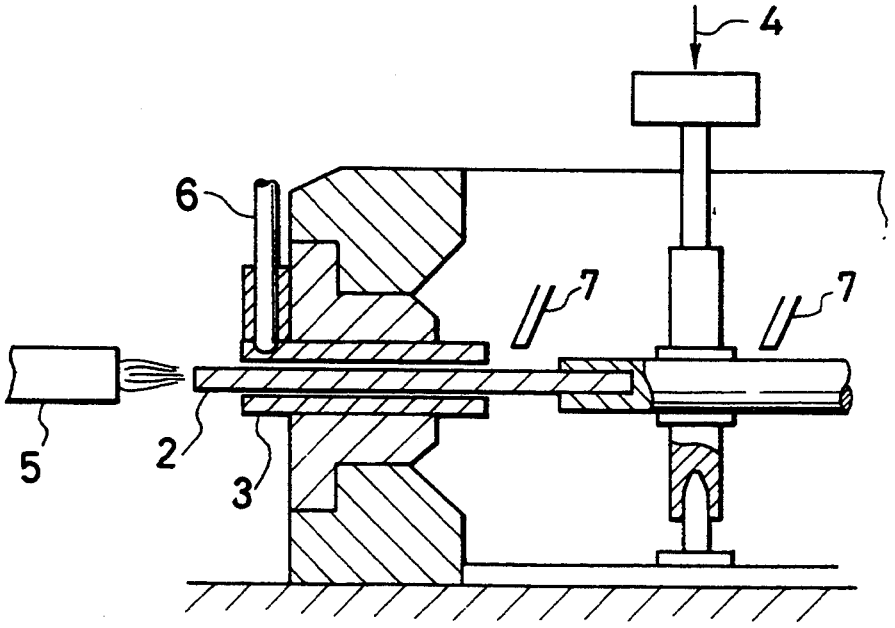
FIG. 2 shows a test device for testing wear and abrasion resistance of the titanium alloy valve shaft of the present invention.

Abrasion Test:

A test machine used for abrasion measurement is shown in FIG. 2. In FIG. 2, a test sample 2 was inserted in a slider guide 3 which is made from iron-based sintered alloy comprising 4–5 wt % of Cu, 1.5–2.5 wt % of C, 0.4–0.5 wt % of Sn, 0.1–0.5 wt % of P and remaining Fe, through which the shaft is to be reciprocated.

Then, while a load weight 4 was applied, the sample 2 was heated by using a burner 5, and reciprocated at the same time through the guide 3. After the duration period passed, the abrasion amount (micrometer: μm) was measured on the side surface of the sample 2. A thermocouple 6 was mounted, and a lubricating oil was fed from a feeding means 7, so as to minimize the abrasion against a reciprocating motion of the sample.

An abrasion test was carried out at the high temperature of 200° C., under the condition of engine rotated at 3,000 rpm, for duration period of 0 to 50 hours.

Figure 3:
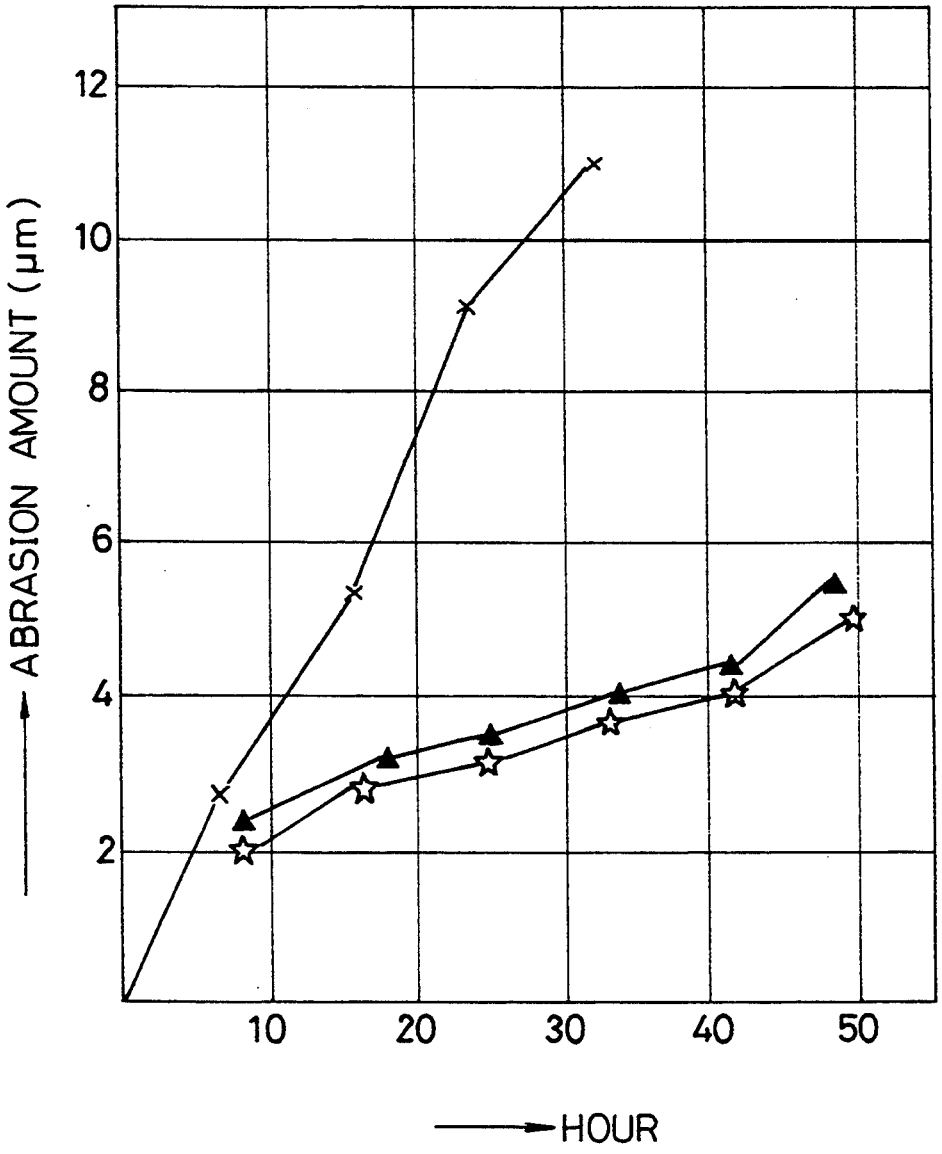
FIG. 3 is a graph showing a result of the wear and abrasion resistance of the inventive titanium alloy valve shaft in comparison with reference valve shaft, where the test is carried out by the test device of FIG. 2.

The result is shown in FIG. 3 in which an abrasion amount (μm;micrometer) on an ordinate is plotted to duration period (hours) on an abscissa. In the graph, the curves indicated by x—x, ▲—▲, ☆—☆, and □—□ are the abrasion amounts of the samples respectively of reference 1, example 4, and references 2 and 3.

Figure 4:
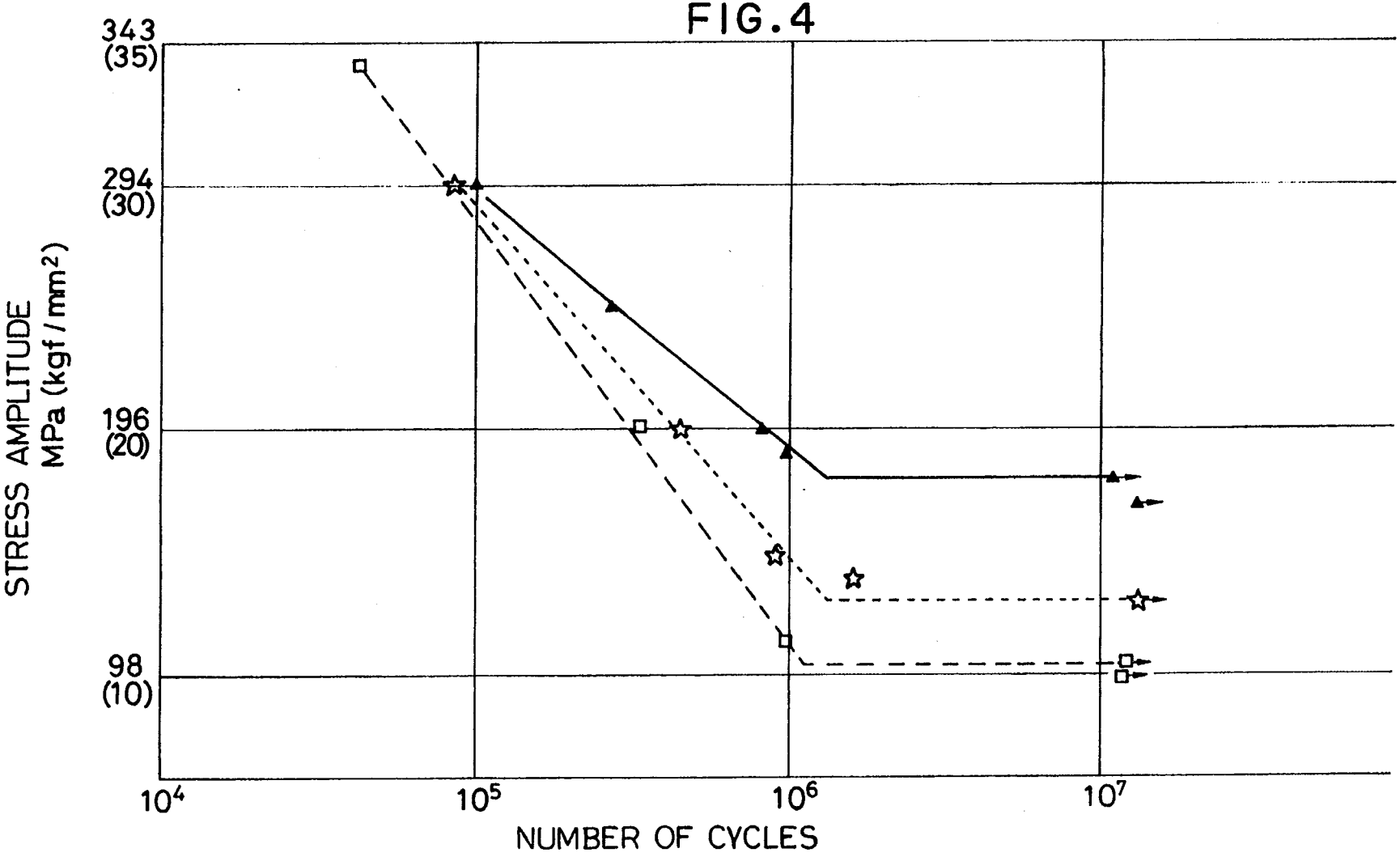
FIG. 4 is a graph showing a result of fatigue strength test for the inventive titanium alloy valve shaft in comparison with reference valve shaft.

Fatigue Test:

Using a rotation fatigue test apparatus, a rotation fatigue test was carried out on samples made in example 4, references 2 and 3 at a room temperature. In FIG. 4, a stress amplitude [in MPa (Kgf/mm)] is plotted to the number of cycles. In FIG. 4, the curves indicated by ▲—▲, ☆—☆, and □—□ are the results of the samples respectively of example 4, and references 2 and 3.

[Consideration]

When the Hv hardness is less than 250, the abrasion resistance are not enough. When the Hv hardness exceeds 600, the fatigue limit will be lowered. Accordingly, the hardness Hv is preferably 250 to 600 for appropriate hardness of the valve shaft surface.

The valve shaft structure of the present invention evidences an improved abrasion resistance at the reciprocation shaft of the valve, and the shaft have a harden surface due to the Ni—P—fine ceramics coating layer which have a Vicker's hardness of 250 to 600 in Hv. Therefore, the valve shaft of the present invention can improve both of abrasion resistance and fatigue resistance.

We claim:

1. An internal combustion engine valve made from titanium alloy, having a shaft, a head and a contact surface coat layer disposed on the surface of the shaft adapted to slide along the surface of a valve guide, said contact surface coat layer containing three components on the surface of the shaft thereof, wherein the composition of the three component coat layer comprises nickel, phospher and particles of material selected from the group consisting of silicone carbide, silicone nitride, boron nitride, and the combination thereof;

said particles are uniformly and homogeneously dispersed in said surface coat layer; and said surface coat layer is formed via a binding layer or directly on the surface of the shaft.

2. The engine valve made from titanium alloy, in accordance with claim 1, wherein the three component coat surface layer is 10 to 30 micrometer thick.

3. The engine valve made from titanium alloy, in accordance with claim 2, wherein the hardness (Hv) of the three component coat surface layer is 250 to 600.

4. The engine valve made from titanium alloy, in accordance with claim 3 wherein said three component coat surface layer contains 2 to 10 weight percent of the particle material on the basis of the whole weight of the three component coat surface layer.

5. The engine valve made from titanium alloy, in accordance with claim 2 wherein said three component coat surface layer contains 2 to 10 weight percent of the particle material on the basis of the whole weight of the three component coat surface layer.

6. The engine valve made from titanium alloy, in accordance with claim 1, wherein the hardness (Hv) of the three component coat surface layer is 250 to 600.

7. The engine valve made from titanium alloy, in accordance with claim 6 wherein said three component coat surface layer contains 2 to 10 weight percent of the particle material on the basis of the whole weight of the three component coat surface layer.

8. The engine valve made from titanium alloy, in accordance with claim 1, wherein said three component coat surface layer contains 2 to 10 weight percent of the particle material on the basis of the whole weight of the three component coat surface layer.

* * * * *

UNITED STATES PATENT AND TRADEMARK OFFICE

CERTIFICATE OF CORRECTION

PATENT NO. : 5,370,364

DATED : December 6, 1994

INVENTOR(S) : Takeji Kenmoku et al

It is certified that error appears in the above-indentified patent and that said Letters Patent is hereby corrected as shown below:

Column 4,

In Table 1, line 53, change ($MN/m^{3|2}$ to --($MN/mm^{3/2}$)--.

Similarly, at line 55, change (Vickers $kg/mm^2$) to --Hv.)--.

Signed and Sealed this

Twenty-seventh Day of June, 1995

*Attest:*

Bruce Lehman

BRUCE LEHMAN

*Attesting Officer*

*Commissioner of Patents and Trademarks*